US012070647B2

(12) United States Patent
Yoon

(10) Patent No.: US 12,070,647 B2
(45) Date of Patent: Aug. 27, 2024

(54) EXERCISE MACHINE SYSTEM CAPABLE OF ADJUSTING WEIGHT BY USING FLOW WEIGHTS

(71) Applicant: Sun Yong Yoon, Yangsan-si (KR)

(72) Inventor: Sun Yong Yoon, Yangsan-si (KR)

( * ) Notice: Subject to any disclaimer, the term of this patent is extended or adjusted under 35 U.S.C. 154(b) by 148 days.

(21) Appl. No.: 17/951,026

(22) Filed: Sep. 22, 2022

(65) Prior Publication Data

US 2023/0107862 A1 Apr. 6, 2023

(30) Foreign Application Priority Data

Oct. 6, 2021 (KR) ..... 10-2021-0132134

(51) Int. Cl.
*A63B 21/075* (2006.01)
*A63B 21/06* (2006.01)
*A63B 24/00* (2006.01)

(52) U.S. Cl.
CPC ..... *A63B 21/075* (2013.01); *A63B 21/0603* (2013.01); *A63B 24/0062* (2013.01); *A63B 2024/0093* (2013.01); *A63B 2220/58* (2013.01)

(58) Field of Classification Search
CPC ..... A63B 21/075; A63B 21/0603; A63B 24/0062; A63B 2024/0093; A63B 2220/58; A63B 21/0724; A63B 21/078; A63B 24/0087
See application file for complete search history.

(56) References Cited

U.S. PATENT DOCUMENTS 3,984,102 A * 10/1976 Evans ..... A63B 21/0083 482/112
4,531,727 A * 7/1985 Pitre ..... A63B 21/0602 482/103
6,350,220 B1 * 2/2002 Milburn ..... A63B 21/0602 482/9
6,447,431 B1 * 9/2002 Milburn ..... A63B 21/0628 482/93
7,798,944 B2 * 9/2010 Suber, III ..... A63B 21/078 482/142
2002/0169055 A1 * 11/2002 Kras ..... A63B 21/008 482/92
2016/0144239 A1 * 5/2016 Sclafani ..... A63B 71/0622 700/282

FOREIGN PATENT DOCUMENTS

FR 2700269 * 1/1993 ..... A63B 21/06
JP S5030279 A * 10/1973 ..... B65G 33/16
KR 101904909 10/2018
KR 102044974 11/2019

* cited by examiner

*Primary Examiner* — Andrew S Lo
*Assistant Examiner* — Andrew M Kobylarz
(74) *Attorney, Agent, or Firm* — CANTOR COLBURN LLP

(57) ABSTRACT

Provided is an exercise machine system capable of adjusting a weight by using flow weights, and more particularly, to an exercise machine system capable of adjusting a weight by adjusting the number of flow weights such as short balls and loading the flow weights in a flow weight loading part of an exercise machine. The exercise machine system capable of adjusting a weight by using flow weights, which is capable of allowing a user to perform an exercise with a desired weight by setting up an exercise weight and supplying the flow weight parts to the flow weight loading part based on the preset exercise weight. Therefore, it is possible to eliminate the inconvenience to the user having to manually adjust the weight.

3 Claims, 6 Drawing Sheets

EXERCISE MACHINE SYSTEM CAPABLE OF ADJUSTING WEIGHT BY USING FLOW WEIGHTS

TECHNICAL FIELD

The present invention relates to an exercise machine system capable of adjusting a weight by using flow weights, and more particularly, to an exercise machine system capable of adjusting a weight by adjusting the number of flow weights such as short balls and loading the flow weights in a flow weight loading part of an exercise machine.

BACKGROUND ART

In general, there are various exercise machines, such as bench presses, expanders, barbells, dumbbells, and pulley-weight exercise machines (home gyms), using weight members. The exercise machine is an exercise machine that applies a resistance load by using a repulsive force of a spring or a weight of a weight member to develop muscles of the body to strengthen health. As the exercise machine using a weight member, an exercise machine using pulley-lifting boards using pulleys is widely used.

Further, a plurality of weights is stacked along a guide rod fixedly installed between an upper frame body and a lower frame body, and a weight head part for moving the weights upward or downward is fitted with the guide rod. The weight head part is connected to a handle by a wire rope.

The weight member exercise machine causes discomfort because a user needs to manually adjust a weight of the weight.

DOCUMENTS OF RELATED ART

Patent Documents

Korean Patent No. 10-2044974 (Nov. 8, 2019)
Korean Patent No. 10-1904909 (Sep. 28, 2018)

SUMMARY OF THE INVENTION

An object of the present invention is to provide an exercise machine system capable of adjusting a weight by using flow weights, which is capable of allowing a user to perform an exercise with a desired weight by setting up an exercise weight and supplying flow weight parts to a flow weight loading part based on the preset exercise weight.

The present invention provides an exercise machine system capable of adjusting a weight by using flow weights, the exercise machine system comprising: a flow weight supply part formed to have a space having a predetermined size to accommodate flow weights having a predetermined weight: a first valve connected to one side of the flow weight supply part and configured to open or close the flow weight supply part: a first length adjustment tube having one side connected to one side of the first valve, and the other side connected to a flow weight loading part, the first length adjustment tube being provided in the form of a tube having a predetermined size and configured to be supplied with the flow weights from the flow weight supply part: the flow weight loading part formed to have a predetermined size and a predetermined space for accommodating the flow weights therein: a second valve connected to one side of the flow weight loading part and configured to open or close the flow weight loading part: a second length adjustment tube having one side connected to the second valve, and the other side connected to a flow weight transfer part, the second length adjustment tube being provided in the form of a tube having a predetermined size and configured to be supplied with the flow weights from the flow weight loading part: the flow weight transfer part connected to the second length adjustment tube and configured to transfer the flow weights: and motors respectively positioned on upper and lower portions of the flow weight transfer part and configured to provide power for operating the flow weight transfer part.

The present invention provides the exercise machine system capable of adjusting a weight by using flow weights, which is capable of allowing a user to perform an exercise with a desired weight by setting up an exercise weight and supplying the flow weight parts to the flow weight loading part based on the preset exercise weight. Therefore, it is possible to eliminate inconvenience to the user having to manually adjust the weight.

DETAILED DESCRIPTION

Terms or words used in the specification and the claims should not be interpreted as being limited to a general or dictionary meaning and should be interpreted as a meaning and a concept which conform to the technical spirit of the present invention based on a principle that an inventor can appropriately define a concept of a term in order to describe his/her own invention by the best method.

Hereinafter, exemplary embodiments of the present invention will be described in detail with reference to the accompanying drawings.

In the present specification, the terms "weight" and "load" are used together, but the terms are deemed to have the same meaning.

The present invention relates to an exercise machine system capable of adjusting a weight by using flow weights, and more particularly, to an exercise machine system capable of adjusting a weight by adjusting the number of flow weights such as short balls and loading the flow weights in a flow weight loading part of an exercise machine.

Figure 1:
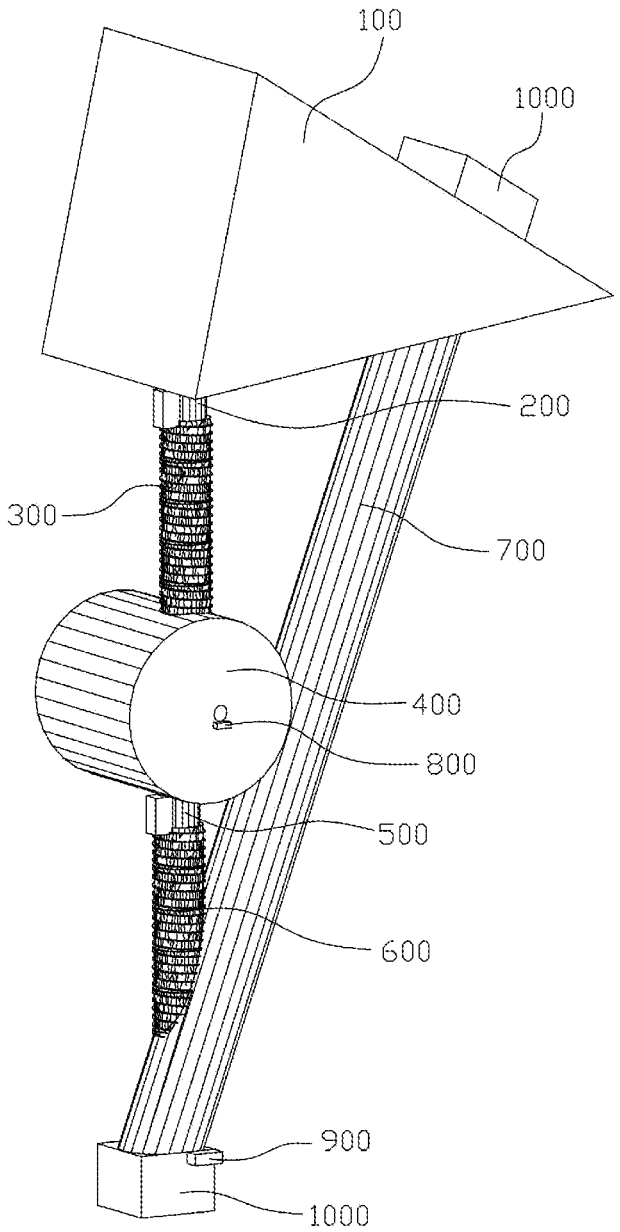
FIG. 1 is a view illustrating an overall appearance of an exercise machine system capable of adjusting a weight by using flow weights according to the present invention.

FIG. 1 is a view illustrating an overall appearance of an exercise machine system capable of adjusting a weight by using flow weights according to the present invention. The present invention includes a flow weight supply part 100, a first valve 200, a first length adjustment tube 300, a flow weight loading part 400, a second valve 500, a second length adjustment tube 600, a flow weight transfer part 700, a load cell 800, a weight detection sensor 900, motors 1000, and a controller 1100.

The flow weights 10 used in the present invention may be short balls having a predetermined weight. In addition to the short balls, the flow weight 10 may be any component having a weight, such as water, sand, or an iron ball.

The flow weight supply part 100 may be formed to have a space having a predetermined size and configured to accommodate the flow weights 10.

The first valve 200 is positioned between the flow weight supply part 100 and the first length adjustment tube 300 and opens or closes the flow weight supply part 100.

One side of the first length adjustment tube 300 is connected to one side of the flow weight supply part 100, and the other side of the first length adjustment tube 300 is connected to the flow weight loading part 400. The first length adjustment tube 300 is provided in the form of a tube having a predetermined size and supplied with the flow weights 10 from the flow weight supply part 100.

The first length adjustment tube 300 may be configured as a corrugated tube, which is a length adjustment tube capable of adjusting a length thereof. In addition to the corrugated tube, a flexible tube or an articulated tube may be applied. The first length adjustment tube 300 may have a shape capable of ensuring free motions in upward, downward, leftward, rightward, and diagonal directions.

The flow weight loading part 400 is formed to have a predetermined size and has a predetermined space to accommodate the flow weights 10 therein. The flow weight loading part 400 is a part that a person uses to perform an exercise. The person may perform an exercise by lifting up the flow weights 10 loaded into the flow weight loading part 400.

The second valve 500 is positioned between the flow weight loading part 400 and the first length adjustment tube 300 and opens or closes the flow weight loading part 400.

The first and second valves 200 and 500 may each be provided in the form of a ball valve so that the flow weights 10 in the form of short balls pass through the first valve 200 and the second valve 500. However, the shape of the valve is not limited.

The opening and closing operations of the first and second valves 200 and 500 are controlled by the controller 1100. The first valve 200 is opened when the flow weights 10 need to move into the flow weight loading part 400. The second valve 500 is opened when the flow weights 10 need to be discharged from the flow weight loading part 400, such that the flow weights 10 in the flow weight loading part 400 are discharged.

One side of the second length adjustment tube 600 is connected to the flow weight loading part 400, and the other side of the second length adjustment tube 600 is connected to the flow weight transfer part 700. The second length adjustment tube 600 is provided in the form of a tube having a predetermined size and supplied with the flow weights 10 from the flow weight loading part 400.

The second length adjustment tube 600 may be configured as a corrugated tube, which is a length adjustment tube capable of adjusting a length thereof. In addition to the corrugated tube, a flexible tube or an articulated tube may be applied. The second length adjustment tube 600 may have a shape capable of ensuring free motions in upward, downward, leftward, rightward, and diagonal directions.

Figure 2:
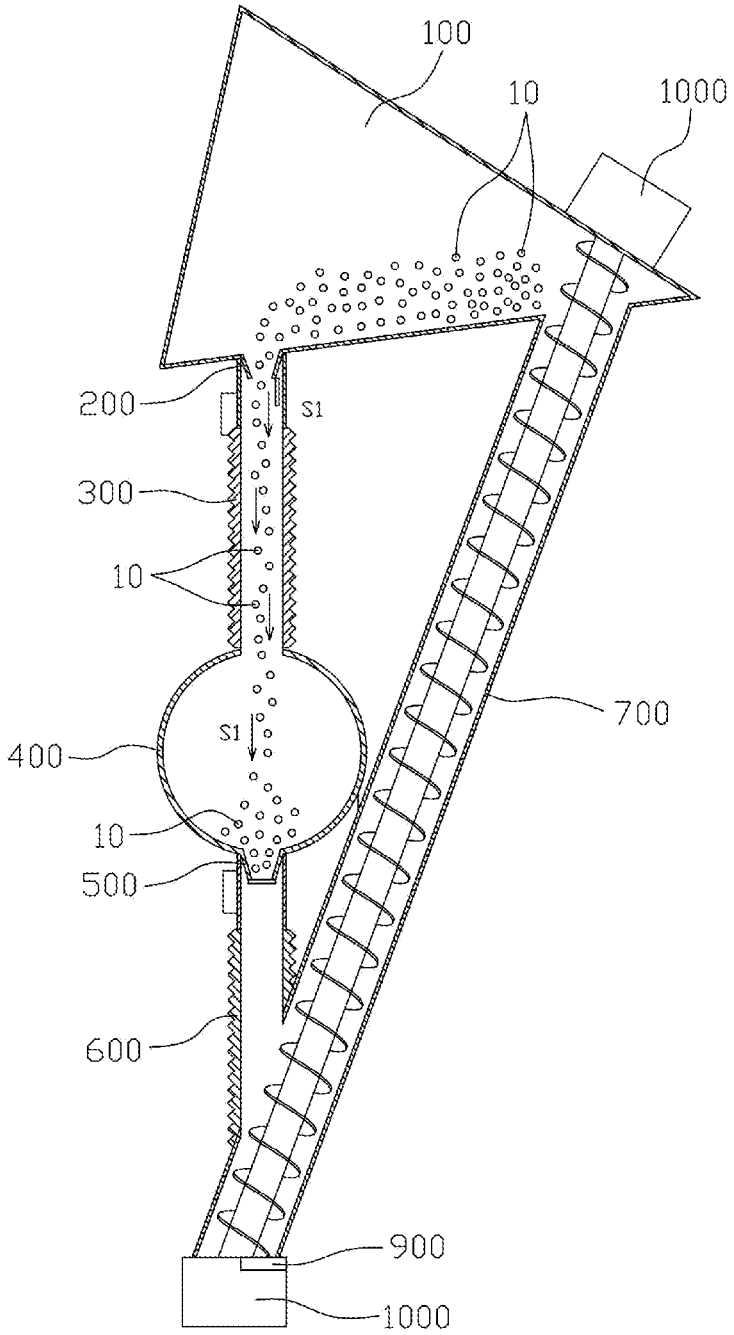
FIGS. 2 to 4 are views illustrating an embodiment of the exercise machine system capable of adjusting a weight by using flow weights according to the present invention.

The flow weight transfer part 700 serves to transfer the flow weights 10. Particularly, the flow weight transfer part 700 may be provided in the form of a conveyor. As illustrated in FIG. 2 that is a transparent view illustrating an interior of the flow weight transfer part 700, the flow weight transfer part 700 may be provided in the form of a screw conveyor having a screw thread shape so that the short balls move smoothly.

The load cell 800 is positioned at one side of the flow weight loading part 400 and measures a change in weight of the flow weight loading part 400.

That is, it is possible to identify the weight in the flow weight loading part 400 when the flow weights 10 are accommodated in or discharged from the flow weight loading part 400. The information on the weight in the flow weight loading part 400, which is measured by the load cell 800, is transmitted to the controller 1100, such that the first valve 200 and the second valve 500 may control the opened or closed state.

The weight detection sensor 900 is a sensor positioned at the bottom motor 1000 and configured to detect the weight. The weight detection sensor 900 detects the weight of the flow weights 10 that move from the flow weight loading part 400 to the second length adjustment tube 600.

The motors 1000 are respectively positioned at upper and lower portions of the flow weight transfer part 700. The motors 1000 provide power for operating the flow weight transfer part 700.

The controller 1100 sets a weight value of a preset amount of flow weights 10 to be loaded into the flow weight loading part 400 and controls any one of the first and second valves 200 and 500 in response to the weight value of the preset flow weights 10 so that any one of the first and second valves 200 and 500 is opened. The controller 1100 receives, in real time, a value of change in weight from the load cell 800. When the controller 1100 receives a weight value equal to the weight value of the preset flow weights 10, the controller 1100 performs control to close the opened first valve 200 or the opened second valve 500. The controller 1100 controls the operations of the motors 1000 so that the motors 1000 operate when the controller 1100 receives, from the weight detection sensor 900, information on a detected weight with a value more than the weight value of the preset flow weights 10, and the operations of the motors 1000 are stopped when the controller 1100 receives information on the detected weight with a value equal to or less than the weight value of the preset flow weights 10.

Figure 3:
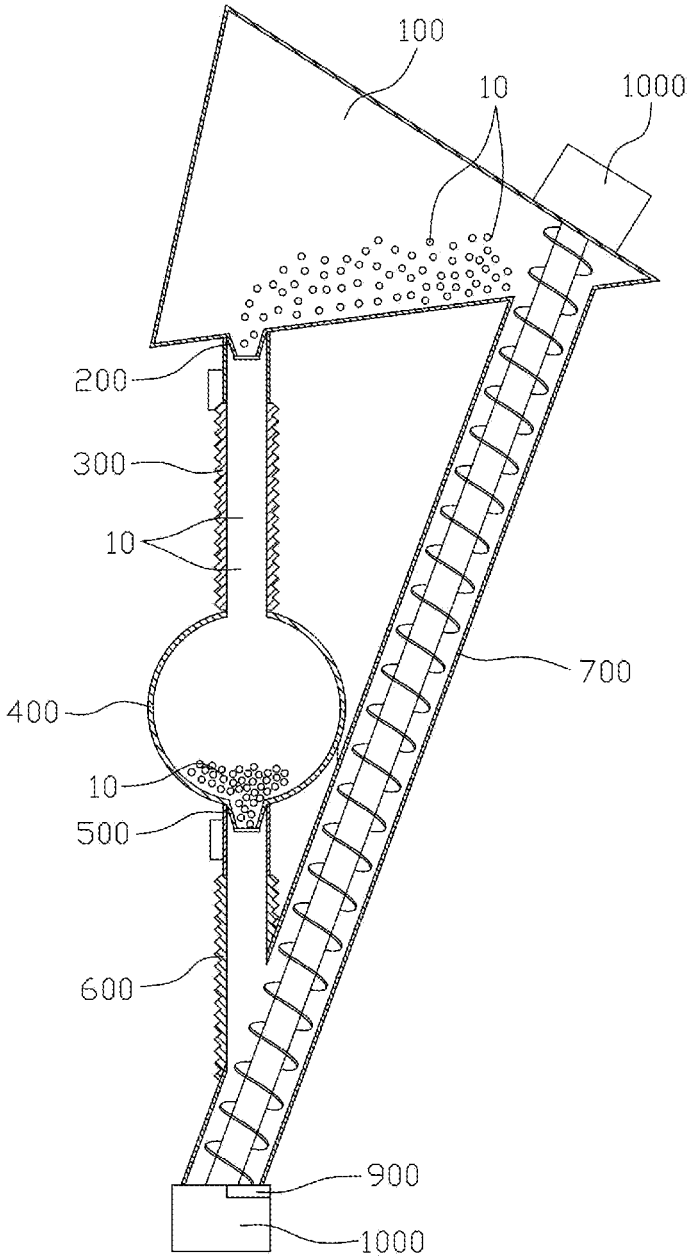
Figure 4:
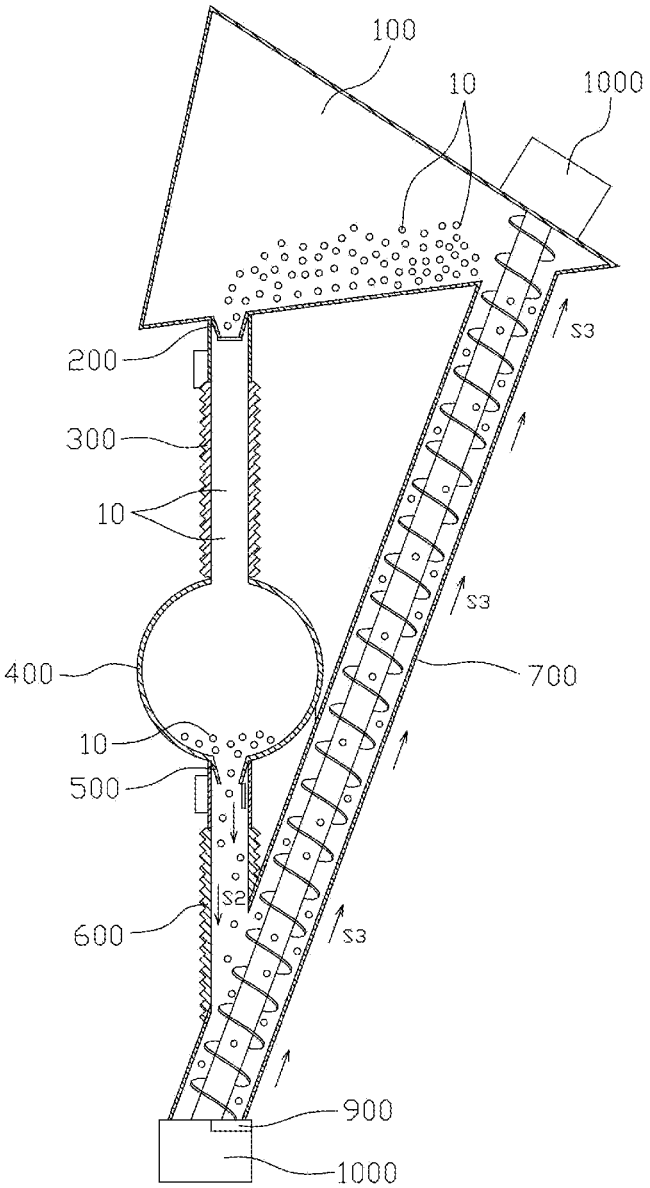

The controller 1100 will be described with reference to FIGS. 2 to 4. FIGS. 2 to 4 are views illustrating an embodiment of the exercise machine system capable of adjusting a weight by using flow weights according to the present invention. FIGS. 2 to 4 are projected views illustrating an interior of the exercise machine system capable of adjusting a weight by using flow weights according to the present invention.

Referring to FIG. 2. in case that a weight value of the flow weights 10 to be loaded into the flow weight loading part 400 is set by the controller 1100 and the flow weights 10 need to be moved from the flow weight supply part 100 to the flow weight loading part 400, the first valve 200 is opened, and the flow weights 10 are moved from the flow weight supply part 100 to the flow weight loading part 400 by the preset weight value (see direction S1).

In this case, when the weight variation value measured by the load cell 800 installed at one side of the flow weight loading part 400 is transmitted to the controller 1100 and the transmitted value is equal to the preset weight value, the first valve 200 is closed, and the flow weights 10 is loaded into the flow weight loading part 400 by the preset weight value, as illustrated in FIG. 3.

In case that the weight value of the flow weight loading part 400 is reset to a value smaller than the preset value, the second valve 500 is opened, and the flow weights 10 stored in the flow weight loading part 400 are discharged to the second length adjustment tube 600 in direction S2, as illustrated in FIG. 4. When the weight detection sensor 900 detects the weight of the flow weights 10, the motors 1000 operate to operate the flow weight transfer part 700, such that the flow weights 10 are moved in direction S3 along a ball screw of the flow weight transfer part 700.

The second valve 500 is opened until the flow weights 10 remain in the flow weight loading part 400 to the extent of the preset weight value. When the weight value reaches the preset weight value, the second valve 500 is closed. In addition, when the weight of the flow weights 10 is not detected by the weight detection sensor 900, the operations of the motors 1000 are stopped so that the operation of the flow weight transfer part 700 is stopped.

Figure 5:
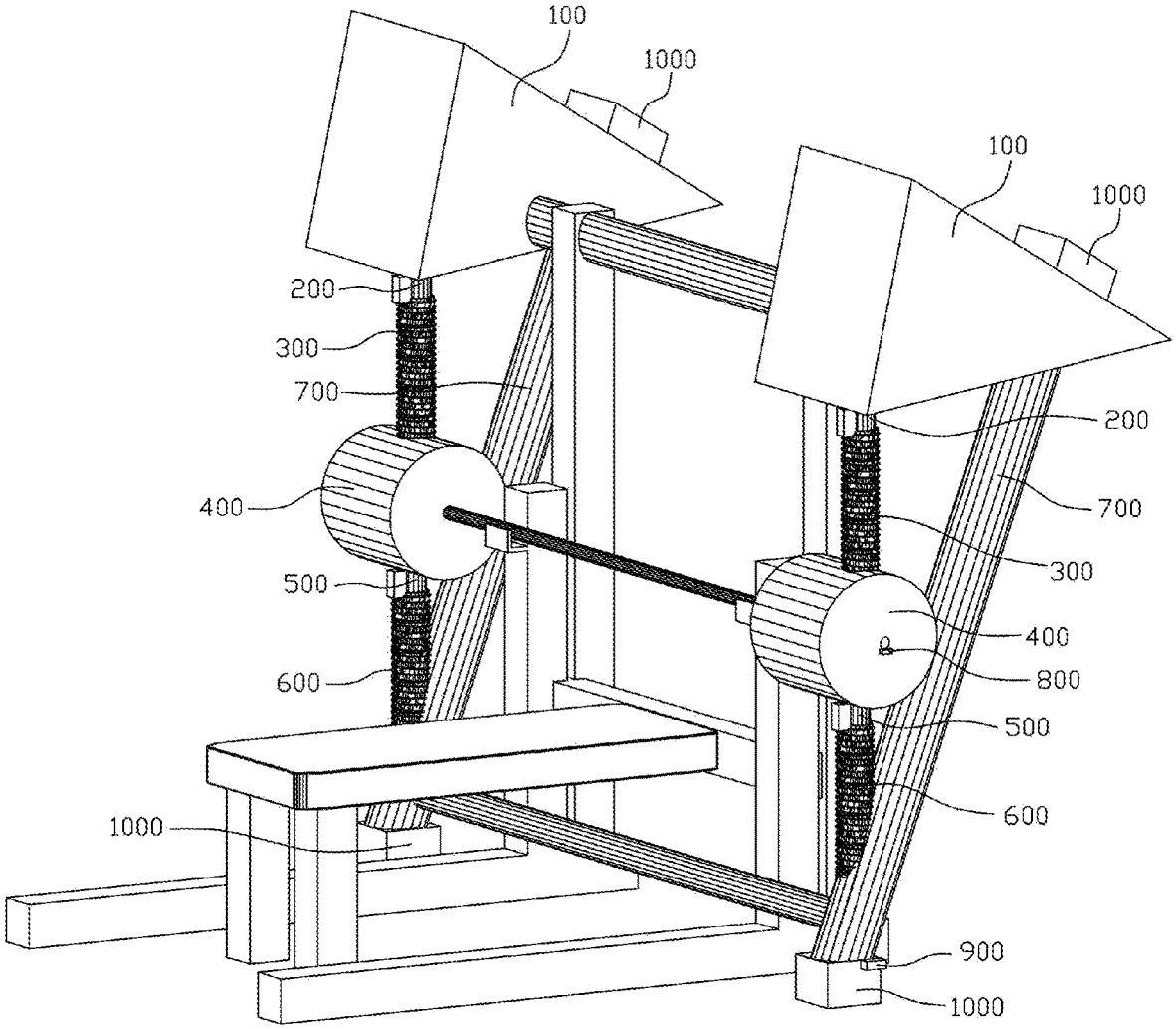
FIG. 5 is a view illustrating an appearance of an exercise machine to which the exercise machine system capable of adjusting a weight by using flow weights according to the present invention is applied.

FIG. 5 is a view illustrating an appearance of an exercise machine to which the exercise machine system capable of adjusting a weight by using flow weights according to the present invention is applied.

As illustrated in FIG. 5, the exercise machine system capable of adjusting a weight by using flow weights according to the present invention may be applied to a bench press. In addition to the bench press, the exercise machine system may be applied to various exercise machines such as a nuclear squat machine or a leg press.

Figure 6:
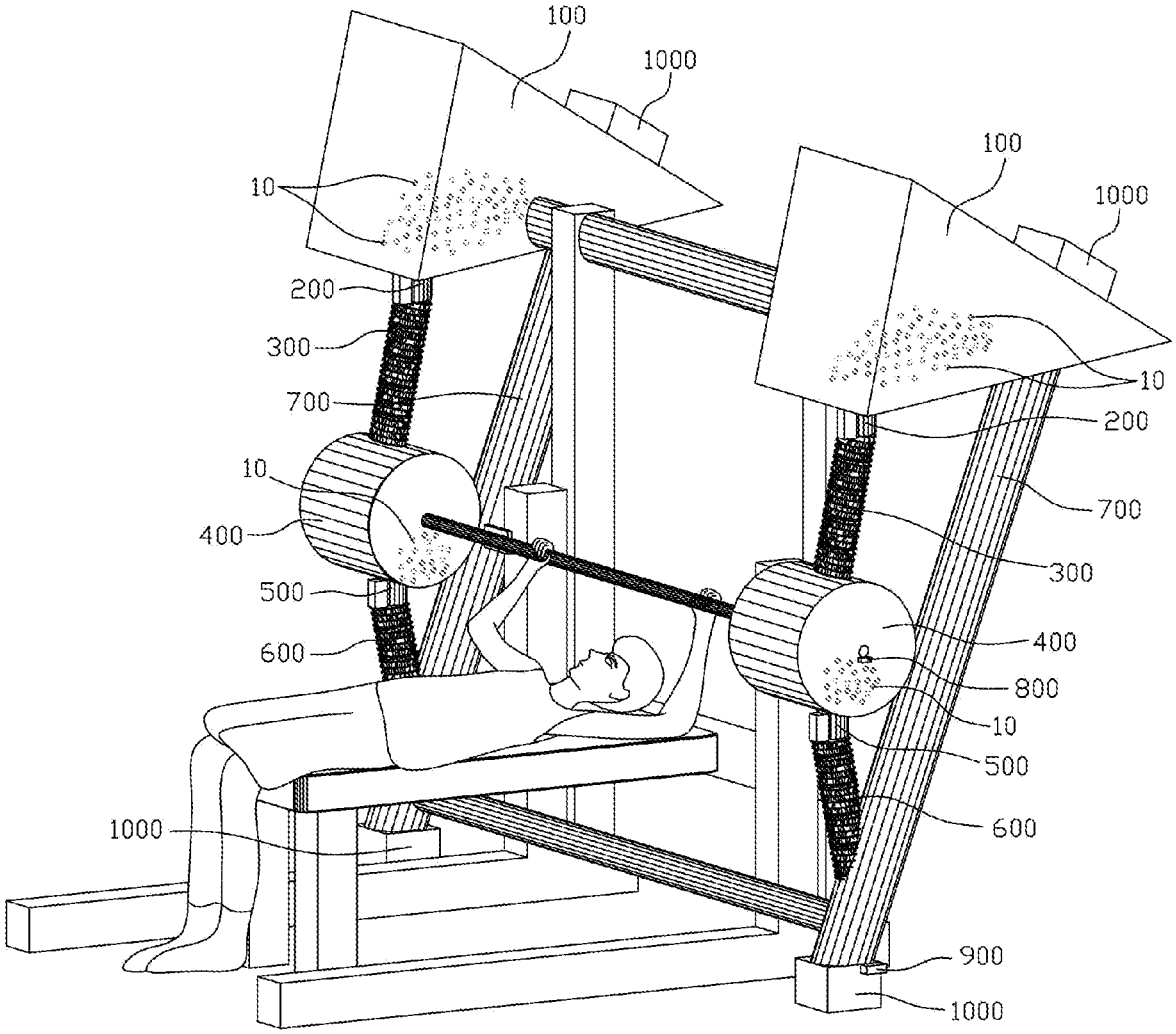
FIG. 6 is a view illustrating a usage state of the exercise machine to which the exercise machine system capable of adjusting a weight by using flow weights the present invention is applied.

FIG. 6 is a view illustrating a usage state of the exercise machine to which the exercise machine system capable of adjusting a weight by using flow weights the present invention is applied.

As illustrated in FIG. 6, the length of the first length adjustment tube 300 and the length of the second length adjustment tube 600 are increased when the user uses the exercise machine. Therefore, the exercise machine system may be easily moved in the upward, downward, leftward, rightward, and diagonal directions, such that the user may perform an exercise by using the exercise machine system according to the present invention without discomfort.

The embodiments disclosed in the present specification and the configurations illustrated in the drawings are just the best preferred embodiments of the present invention and do not represent all the technical spirit of the present invention. Accordingly, it should be understood that various equivalents and modified examples capable of substituting the embodiments may be made.

What is claimed is:

1. An exercise machine system capable of adjusting a weight by using flow weights, the exercise machine system comprising:

a flow weight supply part formed to have a space having a predetermined size to accommodate flow weights having a predetermined weight;

a first valve connected to one side of the flow weight supply part and configured to open or close the flow weight supply part;

a first length adjustment tube having one side connected to one side of the first valve, and the other side connected to a flow weight loading part, the first length adjustment tube being provided in the form of a tube having a predetermined size and configured to be supplied with the flow weights from the flow weight supply part;

the flow weight loading part formed to have a predetermined size and a predetermined space for accommodating the flow weights therein;

a second valve connected to one side of the flow weight loading part and configured to open or close the flow weight loading part;

a second length adjustment tube having one side connected to the second valve, and the other side connected to a flow weight transfer part, the second length adjustment tube being provided in the form of a tube having a predetermined size and configured to be supplied with the flow weights from the flow weight loading part;

the flow weight transfer part connected to the second length adjustment tube and configured to transfer the flow weights;

motors respectively positioned on upper and lower portions of the flow weight transfer part and configured to provide power for operating the flow weight transfer part, a load cell positioned at one side of the flow weight loading part and configured to measure a change in weight of the flow weight loading part; and a weight detection sensor positioned at the bottom motor and configured to detect a weight.

2. The exercise machine system of claim 1, further comprising:

a controller configured to:

set a weight value of a preset amount of flow weights to be loaded into the flow weight loading part;

control any one of the first and second valves in response to the weight value of the preset flow weights so that any one of the first and second valves is opened;

receive, in real time, a weight value from the load cell;

perform control to close the opened first valve or the opened second valve when the controller receives a weight value equal to the weight value of the preset flow weights; and control operations of the motors so that the motors operate when the controller receives, from the weight detection sensor, information on a detected weight with a value more than the weight value of the preset flow weights, and the operations of the motors are stopped when the controller receives information on the detected weight with a value equal to or less than the weight value of the preset flow weights.

3. The exercise machine system of claim 2, wherein the flow weights are short balls.

* * * * *